US006802422B2

(12) United States Patent
Kalvelage et al.

(10) Patent No.: US 6,802,422 B2
(45) Date of Patent: Oct. 12, 2004

(54) SEALED BLISTER ASSEMBLY

(75) Inventors: John D Kalvelage, Decatur, GA (US); Ian E. Salditch, Owings Mill, MD (US); Galen Nickey, Jr., Owings Mill, MD (US); Toomas Ots, Ontario (CA)

(73) Assignee: Multi-Comp, Inc., Owings Mill, MD (US)

( * ) Notice: Subject to any disclaimer, the term of this patent is extended or adjusted under 35 U.S.C. 154(b) by 666 days.

(21) Appl. No.: 09/734,196

(22) Filed: Dec. 12, 2000

(65) Prior Publication Data

US 2002/0104773 A1 Aug. 8, 2002

(51) Int. Cl.[7] ..... B65D 83/04
(52) U.S. Cl. ..... 206/538; 206/534.1
(58) Field of Search ..... 206/528, 534.1, 206/538, 539, 461, 470

(56) References Cited

U.S. PATENT DOCUMENTS 3,111,220 A * 11/1963 Bostrom ..... 206/462
3,346,099 A * 10/1967 Thomas et al. ..... 206/539
3,388,827 A 6/1968 Thanhauser et al.
3,450,252 A 6/1969 Hallerbach
4,163,496 A * 8/1979 Dogliotti ..... 206/538
4,427,705 A 1/1984 Wyslotsky et al.
4,609,121 A 9/1986 Ludwig
4,693,371 A 9/1987 Malpass
5,074,416 A 12/1991 Hustad
5,129,517 A 7/1992 Hustad
5,150,793 A 9/1992 Tannenbaum
5,293,997 A 3/1994 Hustad et al.
5,339,973 A * 8/1994 Edwards et al. ..... 220/4.21
5,377,860 A * 1/1995 Littlejohn et al. ..... 220/4.21
5,398,908 A 3/1995 Kienle
5,582,317 A 12/1996 Wermund
5,602,612 A 2/1997 Angeli et al.
5,791,478 A 8/1998 Kalvelage et al.
5,803,248 A 9/1998 Cox
5,860,549 A * 1/1999 Allers et al. ..... 220/23.87
6,039,495 A 3/2000 Zimmerman et al.

* cited by examiner

*Primary Examiner*—David T. Fidei
(74) *Attorney, Agent, or Firm*—John H. Thomas, P.C.

(57) ABSTRACT

A sealed blister assembly is made up of a plastic sheet and a plastic lid. The plastic sheet and plastic lid are joined together to form a impermeable seal. The seal is formed by engagement of an undercut in the plastic sheet and a shoulder in the plastic lid. A plastic sheet and/or plastic lid are made from a polymer such as low density polyethylene to obtain the impermeable seal.

15 Claims, 2 Drawing Sheets

SEALED BLISTER ASSEMBLY

FIELD OF THE INVENTION

This invention relates to a sealed blister assembly wherein a plastic sheet and plastic lid are joined together to form an impermeable seal. The seal is formed solely by engagement of an undercut in the plastic sheet and a shoulder in the plastic lid. No adhesives or further backing sheets are required to be used to obtain the seal.

BACKGROUND OF THE INVENTION

Blister packages have been well known for many years. They have been used for many purposes in different types of packaging applications. In some inexpensive and undemanding applications, items can be packaged in plastic blisters with simple cardboard backing. The blister sheet and backing may or may not be adhered together.

Industries where blister packaging is widely used include packaging of food and pharmaceutical products. These applications are typically more demanding than other applications, because there is the need for a seal between a blister sheet and lid. The seal is required to keep the food and medications fresh and unspoiled. This is accomplished conventionally by a heat seal or adhesive between the blister sheet and lid. There may also be one or more additional backing sheets to form barrier layers or provide more integrity to a package.

Problems with conventional sealed blister package assemblies include the fact that the adhesive or heat sealing process can adversely affect the product being packaged. Also, the system can be very complicated and difficult to assemble. These types of systems are primarily efficient only in high-volume, manufacturing applications.

SUMMARY OF THE INVENTION

It is accordingly an object of the present invention to overcome the foregoing drawbacks and provide a sealed blister assembly that does not require an adhesive or heat sealing process to seal a blister sheet and a lidding sheet in order to obtain an impermeable seal.

In one embodiment, a sealed blister assembly includes a plastic sheet and plastic lid. The plastic sheet has a recess formed therein, the recess having a perimeter all around an opening into the recess, and the perimeter further comprising an undercut. The plastic lid is adapted to attach to the perimeter of the recess and cover the opening into the recess. The plastic lid comprises a raised ridge having an outside edge adapted to engage the undercut of the plastic sheet around the entire perimeter. The engagement of the ridge and undercut forms the seal, whereby a sealed blister is formed from the plastic lid and the recess of the plastic sheet. The plastic sheet may comprise a plurality of recesses and the plastic lid comprise a corresponding plurality of ridges to form a plurality of sealed blisters. Further, the outside edge of the ridge may comprise walls that flare outwardly. The undercut may comprise side walls, the outside edge of the ridge may comprise walls, and the sealed blister would thereby result from the engagement of the undercut side walls and ridge walls. The plastic sheet and/or the plastic lid may be comprised of polyethylene. Still further, the undercut side walls may flare outwardly in a corresponding fashion to the flared ridge walls. Also, the undercut side walls may be shorter than the ridge walls. The sealed blister formed may be used for packaging a medication, and the sealed blister meets or exceeds the requirements to be a U.S.P. Class A or Class B individual unit-dose container.

In another embodiment, the invention includes a package assembly for dispensing a pharmaceutical medication. The assembly comprises a plastic sheet having a medication receiving recess formed therein. The plastic sheet has a substantially planer shoulder portion disposed along the peripheral portion of the sheet and further with a perimeter around the recess. The package assembly further comprises a pharmaceutical medication positioned in the recess of the plastic sheet. A plastic lid is positioned in an overlaying relationship to the plastic sheet, the plastic lid comprising a raised ridge having an outside edge corresponding to the perimeter of the recess and frictionally engaging the perimeter to thereby close the recess and seal the medication therein. The perimeter of the recess may further comprise an undercut, and the ridge on the plastic lid frictionally engages the undercut to seal the medication therein. Further, the plastic sheet may comprise a plurality of recesses wherein a pharmaceutical medication is positioned in each recess, and wherein the plastic lid comprises a corresponding plurality of ridges to form a plurality of medication-containing sealed blisters.

DETAILED DESCRIPTION OF PREFERRED EMBODIMENTS

Figure 1:
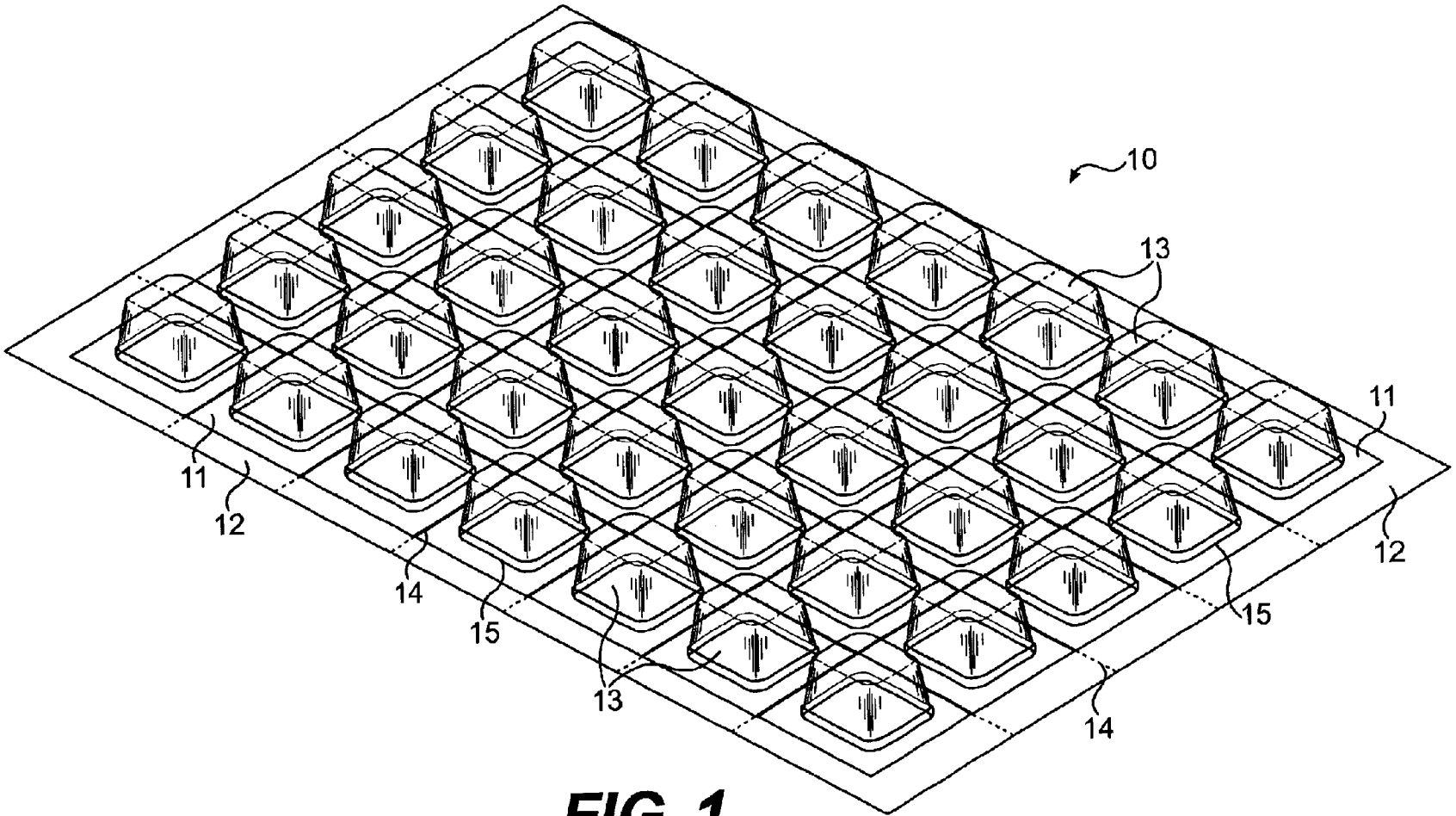
FIG. 1 is a perspective view of an exemplary blister package assembly incorporating the present invention.

Turning first to FIG. 1, there is shown a preferred embodiment of a package assembly 10 which includes the present invention. The package assembly 10 is made up of a number of different components including a plastic blister sheet 11 and an overlying plastic lid 12. The plastic sheet 11 has a plurality of blister recesses 13 formed therein. The blister recesses 13 of the plastic sheet 11 are arranged in a pattern and are separated by flat shoulder portions 15 between the blister recesses. The particular package assembly 10 shown is for dispensing pharmaceutical medications; therefore, the blister recesses 13 are arranged in a matrix of rows and columns that correspond to a calendar or some other schedule convenient for a particular patient. Perforations 14 on the plastic lid 12 and the plastic sheet 11 form preweakened areas that allow the individual blister assemblies to be separated from each other.

Figure 2:
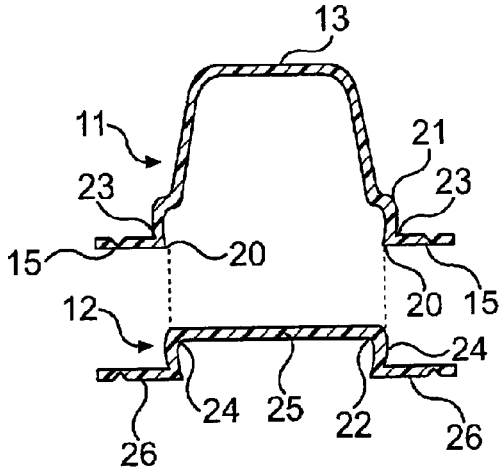
FIG. 2 is a side elevation, cross-sectional, exploded view of a blister sheet and lid of the present invention.
Figure 3:
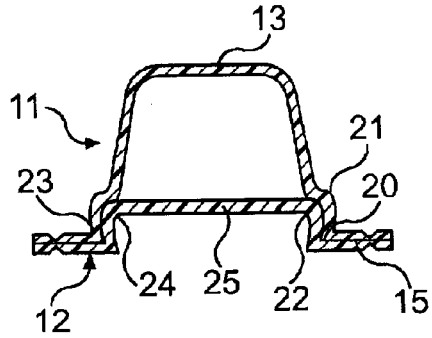
FIGS. 3–5 are side elevation, cross-sectional views of alternative embodiments of a blister sheet and lid of the present invention.

FIGS. 2 and 3 illustrate the cross sectional view of a single blister from the blister package 10 shown in FIG. 1. FIG. 2 is merely an exploded view where the plastic sheet 11 and the plastic lid 12 are separated by a dotted line. FIG. 3 shows the plastic sheet 11 sealed to the plastic lid 12. The plastic sheet 11 defines a recess 13. This recess 13 is the blister into which medicines, food or other products can be packaged. The recess 13 is defined by its perimeter 20 that separates the recess 13 from the shoulder portion 15. Contiguous with the perimeter 20, and forming a portion of the recess 13 is an undercut 21. The undercut 21 is made up of side walls 23 that angle upwardly from the shoulder 15. In a preferred embodiment, the side walls 23 flare outwardly, i.e., the side walls form an acute angle with the shoulder portion 15. In a preferred embodiment, the sidewalls 23 and shoulder portion 15 form an angle slightly less than perpendicular, preferably in the range of about 7°. As an alternative to a straight angle, ridge wall 24 and sidewalls 23 may alternatively be radiused in a corresponding similar fashion to create an impermeable seal.

The plastic lid 12 has a raised ridge 22 that is made up of ridge walls 24. The flat top 25 of the ridge 22 forms the bottom of the sealed blister package defined by the blister recess 13 and the top 25. In the preferred embodiment, the ridge walls 24 flare outwardly so as to form an acute angle with the shoulder portion 26 of the plastic lid 12. The angle of the flare is adapted to be substantially identical to the angle of the flare in the plastic sheet wherein the side walls 23 of the undercut 21 flare outwardly. In this way, the plastic lid 12 will frictionally engage the plastic sheet 11 along the inside of the side walls 23 the outside edge of the ridge walls 24. This fit between the plastic sheet 11 and plastic lid 12 must be very specifically engineered in order to be able to obtain a very tight fit between the respective components. In a preferred embodiment where an assembly is provided for dispensing pharmaceutical medications (e.g., assembly 10), the blister shape is approximately rectangular with rounded corners and the dimensions are approximately ¾"×⅞". The length and width dimensions of the ridge 22 are slightly larger than the corresponding dimensions of the undercut 21 to better form the impermeable seal therebetween. In a preferred example the ridge 22 dimensions are 0.002" larger than the undercut 21 dimensions.

Figure 4:
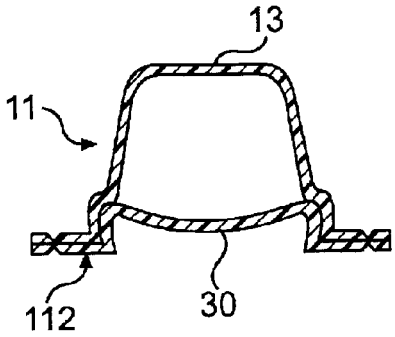

FIG. 4 discloses an alternative embodiment where the top 30 of the plastic lid 112 is slightly bulged to form a small bubble or protuberance in the bottom of the blister package. This facilitates separation of the plastic lid 112 from the plastic sheet 11 when a user seeks access to the content of the blister.

Figure 5:
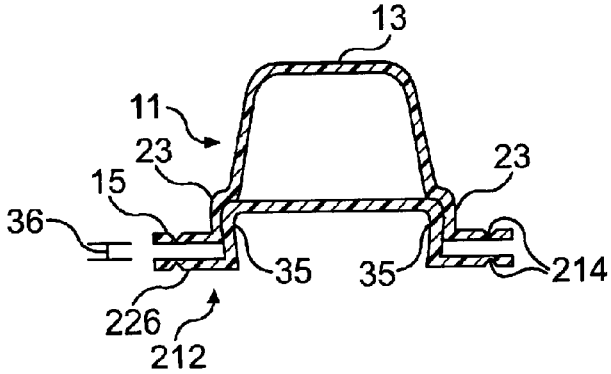

FIG. 5 is a still further embodiment where the plastic sheet 11 is sealed to a plastic lid 212. The ridge walls 35 of the plastic lid 212 are longer than the side walls 23 of the plastic sheet 11. In this way, a gap 36 is formed between the shoulder portions 226 and 15. The purpose of this gap 36 is to facilitate the separation of individual blisters from a blister package similar to package 10. In other words, when this blister is folded, the gap 36 provides extra leverage to snap the perforation 214 and separate a single blister.

The polymer or polymers used to make the plastic blister sheet 11 and lidding sheet 12 are a matter of selection by a packaging engineer for a given application. In the medication packaging assembly 10 shown in FIG. 1, it is preferred that the plastic sheet 11 and/or the lidding sheet 12 include polyethylene, and specifically a low density polyethylene. Low density polyethylene has a "softness" that allows the plastic layer to seal as required. Most advantageously, both the plastic sheet 11 and lidding sheet 12 are made from low density polyethylene. Nevertheless, it is only required that the polymer have the ability to form an impermeable seal. Consequently, other polymers may be used including, without limitation, other polyethylenes, polypropylenes, polystyrenes, polyesters, vinyls, and blends thereof. In order to obtain an impermeable seal to comply with different medication dispensing and food packaging applications, the plastic must have sufficient barrier properties to prevent air/vapor/liquid ingress and egress in the package assembly. Accordingly, coextruded and laminated products may be used to combine the properties of two or more polymers. For instance, a low density polyethylene may be an outside layer of a plastic sheet in order to achieve a desirable seal. However, a layer of barrier material, for instance, EVOH, may be laminated onto the polyethylene or sandwiched between layers of polyethylene to obtain a superior impermeable layer. In another example, a stiff plastic such as a polyester may be used to provide a certain desirable stiffness for the assembly. The polyethylene and/or a barrier layer could be coextruded with or laminated onto the polyester layer. The thickness of the polymer is again the choice of the packaging engineer. In the specific example of a medication packaging assembly, the polyethylene layer is 0.001 inches thick and is laminated onto a base film of a vinyl or polyester.

Because it would be desirable to also print on the plastic sheet 11 or lidding sheet 12, it is possible to have a printable polymer laminated or coextruded on the outside of the plastic so that written indicia or other designs may be applied to a package assembly. The printing may also be achieved by engraving of indicia on the lid. The specific technology of printing or engraving is known to those in polymer labels areas.

As discussed herein, one preferred embodiment of the present invention is as a medication dispensing assembly. Pharmaceutical medications may mean pills, capsules, tablets, liquid medicines, etc. There are numerous other applications such as food packaging or liquid packaging that could be used in connection with the present invention.

EXAMPLE

A medication packaging assembly as shown in FIG. 1 was assembled and submitted for permeation testing in accordance with USP guidelines. Specifically, the permeation guidelines are disclosed in USP 24 [671 Containers—Permeation] page 1936. The USP test methods are used to define a container in accordance with Class A, Class B, Class C, etc. certifications.

The specific container submitted for analysis in this example was formed from a multi-layer film comprising polyethylene (1.5 mils) and PET (15 mils). Generally rectangular recesses formed the blisters (See FIG. 1). Four different blister packs were tested over four weeks in accordance with Method II. The following is the results that were reported by the laboratory.

UNIT-DOSE CONTAINERS FOR CAPSULES AND TABLETS PERMEATION TEST

Results

| Blister Pack No. | Rate of Permeation (mg/day) 1 Week | 4 Weeks |
|---|---|---|
| 1 | 3.2 | * |
| 2 | 3.2 | * |
| 3 | 3.3. | * |
| 4 | 3.5 | * |

*Permeation rate cannot be reported because pellets were pink at Day 28.

It was reported that none of the blister packs exceeds an average moisture permeability rate of 5 mg/day. These unit-dose containers as tested in Method II are therefore considered to be U.S.P. Class B containers.

While the invention has been described with reference to specific embodiments thereof, it will be understood that numerous variations, modifications and additional embodiments are possible, and accordingly, all such variations, modifications, and embodiments are to be regarded as being within the spirit and scope of the invention.

What is claimed is:

1. A sealed blister assembly comprising:

a plastic sheet having a recess formed therein, the recess having a perimeter all around an opening into the recess, and the perimeter further comprising an undercut;

a plastic lid adapted to attach to the perimeter of the recess and cover the opening into the recess, the plastic lid comprising a raised ridge having an outside edge adapted to engage the undercut of the plastic sheet around the entire perimeter, wherein the engagement of the ridge and undercut forms a impermeable seal, whereby a sealed blister is formed from the plastic lid and the recess of the plastic sheet, and further wherein the sealed blister does not exceed a moisture permeability rate of 5 mg/day.

2. The sealed blister assembly described in claim 1, wherein the plastic sheet comprises a plurality of recesses, and wherein the plastic lid comprises a corresponding plurality of ridges to form a plurality of sealed blisters.

3. The scaled blister assembly described in claim 1, wherein the outside edge of the ridge comprises walls that flare outwardly.

4. The sealed blister assembly described in claim 1, wherein the undercut comprises sidewalls, the outside edge of the ridge comprises walls, and further wherein the inside of the sidewalls are in frictional engagement with the outside edge of the ridge walls.

5. The sealed blister assembly described in claim 3, wherein the undercut comprises sidewalls, and further wherein the inside of the sidewalk are in frictional engagement with the outside edge of the ridge.

6. The sealed blister assembly described in claim 1, wherein the plastic sheet is comprised of polyethylene.

7. The sealed blister assembly described in claim 1, wherein the plastic lid is comprised of polyethylene.

8. The sealed blister assembly described in claim 6, wherein the plastic lid is comprised of polyethylene.

9. The sealed blister assembly described in claim 5, wherein the undercut sidewalls flare outwardly in a corresponding fashion to the flared ridge walls.

10. The sealed blister assembly described in claim 4, further wherein the undercut sidewalls are shorter than the ridge walls.

11. A package assembly for dispensing a pharmaceutical medication comprising:

a plastic sheet having a medication receiving recess formed therein and with a substantially planar shoulder portion disposed along the peripheral portion of the sheet and further with a perimeter around the recess;

a pharmaceutical medication positioned in said recess of said plastic sheet;

a plastic lid positioned in an overlying relationship to the plastic sheet, the plastic lid comprising a raised ridge having an outside edge corresponding to the perimeter of the recess and frictionally engaging the perimeter to thereby close the recess and impermeably seal the medication therein, wherein the sealed recess does not exceed a moisture permeability rate of 5 mg/day.

12. The package assembly set forth in claim 11, wherein the perimeter further comprises an undercut, and the ridge frictionally engages the undercut to seal the medication therein.

13. The package assembly set forth in claim 11, wherein the plastic sheet comprises a plurality of recesses, wherein pharmaceutical medication is positioned in each recess, and wherein the plastic lid comprises a corresponding plurality of ridges to form a plurality of medication—containing sealed blisters.

14. A sealed blister assembly set forth in claim 1, wherein the length and width dimensions of the ridge are larger than the corresponding dimensions of the undercut.

15. A package assembly set forth in claim 12, wherein the length and width dimensions of the ridge are larger than the corresponding dimensions of the undercut.

* * * * *